United States Patent [19]

Inman

[11] Patent Number: 4,678,108

[45] Date of Patent: Jul. 7, 1987

[54] GOLF BALL CARRIER

[76] Inventor: Charles S. Inman, 1506 - Fifth St., New Brighton, Pa. 15066

[21] Appl. No.: 875,472

[22] Filed: Jun. 18, 1986

[51] Int. Cl.[4] ..... A47F 1/08

[52] U.S. Cl. ..... 224/274; 221/185; 224/919

[58] Field of Search ..... 224/252, 196, 918, 919, 224/274; 206/319.9; 221/185

[56] References Cited

U.S. PATENT DOCUMENTS

| | | | |
|---|---|---|---|
| 516,967 | 3/1894 | Dudley | 221/185 |
| 715,759 | 12/1902 | Crane | 206/315.9 |
| 1,421,955 | 7/1922 | Kemp | 206/315.9 |
| 1,572,383 | 2/1926 | Dennys | 206/315.9 |
| 1,621,329 | 3/1927 | Malone | 206/315.9 |
| 1,625,856 | 4/1927 | Judd | 206/315.9 |
| 1,718,952 | 7/1929 | Fischer | 206/315.9 |
| 1,722,134 | 7/1929 | Fredette | 206/315.9 |
| 1,754,495 | 4/1930 | Anderson | 206/315.9 |
| 1,778,225 | 10/1930 | Morss | 206/315.9 |
| 2,024,484 | 12/1935 | Smith | 224/919 X |
| 2,073,328 | 3/1937 | Wasserlein, Sr. | 221/185 X |
| 2,709,027 | 5/1955 | Kozub | 206/315.9 |
| 2,779,578 | 1/1957 | Corey | 206/315.9 |
| 2,791,255 | 5/1957 | Ogden | 206/315.9 |
| 2,950,748 | 8/1960 | Olinghouse | 206/315.9 |
| 3,206,067 | 9/1965 | Smith, Jr. et al. | 221/185 X |
| 3,756,299 | 9/1973 | Simmons et al. | 206/315.9 |
| 3,777,933 | 12/1973 | Joliot | 206/315.9 |
| 3,845,889 | 11/1974 | Hurd | 221/185 |
| 4,042,156 | 8/1977 | Knight | 206/315.9 |
| 4,088,251 | 5/1978 | Rodriguez | 206/315.9 |
| 4,106,678 | 8/1978 | Thomas | 206/315.9 |
| 4,256,244 | 3/1981 | Gasper | 206/315.9 |
| 4,296,874 | 10/1981 | Evans | 206/315.9 |
| 4,299,345 | 11/1981 | Lanzl | 224/919 X |
| 4,339,120 | 7/1982 | Czarny | 224/919 X |
| 4,416,404 | 11/1983 | Daniels | 206/315.9 |
| 4,573,610 | 3/1986 | Hurner | 224/918 X |

*Primary Examiner*—Stephen Marcus
*Assistant Examiner*—Robert M. Petrik
*Attorney, Agent, or Firm*—Harry D. Anspon

[57] ABSTRACT

A tubular golf ball carrier of rigid plastic shaped like a slight gauge and normally carried in an upright manner retains golf balls within tubular carrier with sight opening. Reducing couplings are attached to the ends of the tubular section with sight opening. The bottom coupling has an aperture too small to pass a British golf ball. The top coupling has an aperture large enough to pass a U.S.G.A. golf ball. The top coupling retains a thin flexible annular ring between its inside upper wall and the upper rim of the tubular section. The flexible annular ring flexes to permit ball entry and withdrawal when a golf ball is pushed against it, but when relaxed it prevents a golf ball from rolling out of the carrier. The flexible annular ring is sized for either U.S.G.A. or British golf balls and is removable for use of the annular ring corresponding to the golf balls being played. The tubular carrier is attached to a golf club bag through holes with a rivet and/or other attaching means.

10 Claims, 6 Drawing Figures

GOLF BALL CARRIER

BACKGROUND OF THE INVENTION

1. Field of the Invention

This invention pertains to a ball carrier and more specifically to a golf ball carrier. This golf ball carrier normally is mounted on the side of a golf bag. This mounting commonly is a fixed permanent type of mounting. However, this ball carrier can be mounted on belts or straps which can be employed to mount the ball carrier on a golf bag in a temporary type of mounting. This golf ball carrier also can be mounted on a hook which is placed over the lip of a golf bag in another temporary type of mounting.

2. Description of the Prior Art

This disclosure provides a rigid plastic tubular golf ball carrier which retains golf balls within the tubular carrier and which carrier normally is in a vertical position. The carrier has an open sight cut into the tubing parallel to the length of the tubing to visually determine the balls present. The carrier has a bottom coupling retaining the balls in the carrier. The bottom coupling has a bottom opening allowing for finger assisted upward movement of the bottom ball. The top coupling has a ball opening above a flexible annular ring. The golf balls can be inserted or removed from the carrier through the opening in the top coupling and can be pressed through the flexible annular ring. The flexible annular ring prevents golf balls from rolling out of the rigid plastic tubular carrier whenever the carrier is in a horizontal position.

The following patents are considered to represent the prior art on ball carriers. The listed patents comprise prior art on tennis ball, golf ball or game ball carriers.

| U.S. Pat. No. | Date | Name |
|---|---|---|
| 715,759 | 12/02 | Crane |
| 1,421,955 | 7/22 | Kemp |
| 1,572,383 | 2/26 | Dennys |
| 1,621,329 | 3/27 | Malone |
| 1,625,856 | 4/27 | Judd |
| 1,718,952 | 7/29 | Fischer |
| 1,722,134 | 7/29 | Fredette |
| 1,754,495 | 4/30 | Anderson |
| 1,778,225 | 10/30 | Morss |
| 2,709,027 | 5/55 | Kozub |
| 2,779,578 | 1/57 | Corey |
| 2,791,255 | 5/57 | Ogden |
| 2,950,748 | 8/60 | Olinghouse |
| 3,756,299 | 9/73 | Simmons et al. |
| 3,777,933 | 12/73 | Joliot |
| 4,042,156 | 8/77 | Knight |
| 4,088,251 | 5/78 | Rodriguez |
| 4,106,678 | 8/78 | Thomas |
| 4,256,244 | 3/81 | Gasper |
| 4,296,874 | 10/81 | Evans |
| 4,416,404 | 11/83 | Daniels |

Of the above patents, the only patents disclosing an elastic or resilient annular ring to allow ball entry were U.S. Pat. No. 1,778,225 and U.S. Pat. No. 4,088,251. However, U.S. Pat. No. 4,416,404 uses elastic strips to form gathers in a textile material tube, and U.S. Pat. No. 4,296,874 employs an elastic slot at the bottom of a tubular holder.

While U.S. Pat. No. 4,088,251 mentions a resilient inner projection of smaller diameter than conventional tennis balls, it is utilized only to pick up tennis balls and not to remove them. Its construction appears to be either a projection from the main tube or an additional piece of resilient material such as rubber. The ability to partially compress the walls of the tennis ball seems important to the functioning of this pickup system. Tennis balls are said to snap through the opening.

U.S. Pat. No. 1,778,225 possesses elastic annular rings to add or remove golf balls at the top or bottom of a tubular container with flexible walls. The flexible walls are important since they are employed to eject the golf balls by partially collapsing the flexible tube walls. The flexible tube is distinct from the rigid plastic tubing of this disclosure. In U.S. Pat. No. 1,778,225 the flexible annular flanges are secured to the ring shaped members at the ends of the tubular holder and are integral with the ring shaped members.

In the rigid plastic tubular construction of this disclosure, the flexible annular ring is free to move and flex within its rigid plastic constraining groove. The present invention provides for use of more than one flexible annular ring. Thus, the annular rings may be dimensioned for use of British or U.S.G.A. regulation golf balls. The movement of the flexible annular ring within the constraining groove of this disclosure allows for easy entry or withdrawal of the golf balls, while providing for their sure retention in the carrier whenever it is placed in a horizontal position. The sight opening and the openings at the top and bottom couplings allow for viewing the balls and for ease of movement of the balls in the carrier of this invention by direct finger manipulation of the contained balls in contrast to the flexible tubular walls of U.S. Pat. No. 1,778,225 which must be manipulated to indirectly move and remove unseen golf balls.

The flexible annular ring may be removed and replaced with an annular ring of the dimensions for the golf balls employed by moving the flexible annular ring with the fingers operating through the sight opening and the top coupling aperture. Folding of the ring allows it to be withdrawn or added through the openings. Unfolding the ring while positioning it on its support groove completes its installation.

SUMMARY OF THE INVENTION

This invention discloses a golf ball carrier which retains golf balls in a rigid plastic tubular carrier with a sight opening parallel to the tubular axis whereby the contained balls may be visually determined. The balls may not be removed through the sight opening in the rigid plastic tubular carrier since the sight opening is less than the diameter of the smaller golf ball (British) and the walls resist flexing. The carrier normally is positioned with the tubular axis in a vertical position. There is a top coupling with an aperture through which the golf balls may be added and withdrawn. The inside wall of the top coupling fits onto the outside wall of the tubular section with the sight gaugelike opening. Between the top inside shoulder of the top coupling and the top of the tubular section there is a small space left into which is fitted a thin flexible annular ring. This flexible annular ring is constructed so that golf balls can be inserted at the top of the carrier and passed through the annular ring to the body of the carrier. The annular ring flexes to allow ball entry or exit when assisted with finger pressure on the golf ball.

The golf balls are retained in the carrier by a bottom coupling whose inner walls fit over the outside wall of the tubular section with the sight opening. This bottom coupling possesses an aperture which is smaller than the smaller golf ball (British).

The flexible annular ring relaxes when a golf ball is not being pushed through it. In its relaxed position (as a flat ring) the flexible annular ring prevents golf balls within the carrier from rolling out of the carrier when the carrier is placed in a horizontal position (with the tubular axis horizontal).

When golf balls are to be removed, they are pushed upward against the flexible annular ring which flexes upward, allowing ball exit. Finger pressure on the balls is applied through the sight opening.

The flexible annular ring is removable and replaceable so that an annular ring sized for either United States or British golf balls may be employed.

BRIEF DESCRIPTION OF THE DRAWINGS

FIG..1 is a front view of the ball carrier of this disclosure.

DESCRIPTION OF THE PREFERRED EMBODIMENTS

Figure 1:
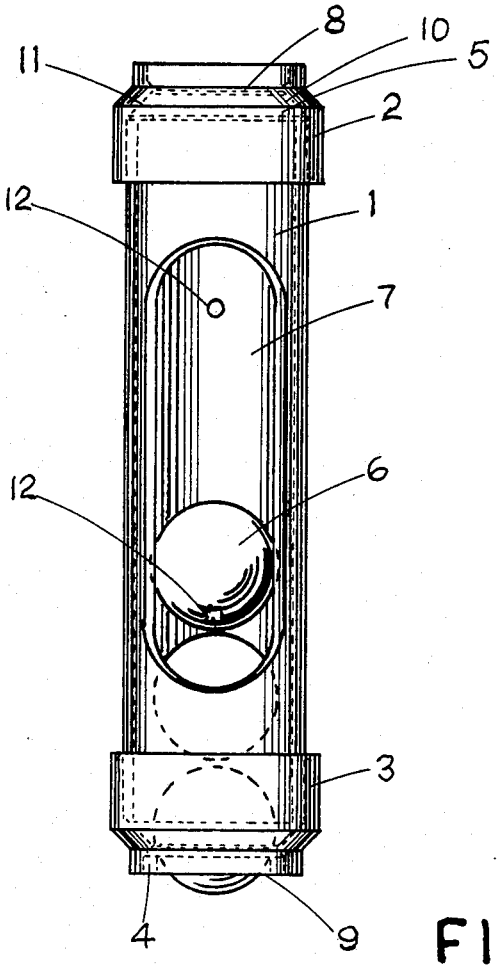

In the drawing of FIG. 1, 1 is a rigid tubular plastic section of the carrier, 2 is a top coupling which is affixed to the tubular plastic part 1, and 3 is an affixed bottom coupling to the tubular plastic part 1.

While it is possible to use a bottom coupling 3 which is one piece, it is preferable to use a bottom coupling 3 which is similar to the top coupling 2 and to which an annular bottom retaining ring 4 is joined either mechanically by pins or threads or adhesively with plastic cements. This retaining ring 4 is shown by dotted lines at the bottom of the bottom plastic coupling 3.

Also shown by dotted lines in FIG. 1 is a flexible annular ring 5 which flexes to permit addition and withdrawal of golf balls 6 from the tubular part 1 of the carrier. When this flexible annular ring 5 is relaxed, it prevents golf balls 6 from rolling out of the carrier whenever the tubular part 1 of the carrier is placed in a horizontal position.

The numeral 7 represents an open sight cut into the side of the rigid plastic tubing 1. The golf balls 6 may be manipulated by fingers inserted at the open sight. The opening at the sight 7 is made small enough to retain British Golf balls.

There is an aperture 8 in top coupling 2 for ball addition and withdrawal. There is a bottom aperture 9 which is smaller than a British golf ball. This bottom aperture 9 in bottom coupling 3 allows the bottom ball to be moved upward by the fingers. There is a spacing 10 between the top of the rigid plastic tubing 1 and the inside wall shoulder of the top coupling 2 for seating of the flexible annular ring 5. The inside wall of the top coupling 2 possesses a tapered opening 11 from the inside diameter of top coupling 2 at its aperture opening 8 to the inside shoulder which mates with the upper rim of tubular part 1. This tapered opening 11 allows space for upward flexing of the flexible annular ring 5. The holes 12 are used to mechanically mount the ball carrier upon a golf bag. The upper hole is visible in FIG. 1. The lower one of the holes 12 is indicated by dotted lines behind one of the golf balls 6.

Figure 2:
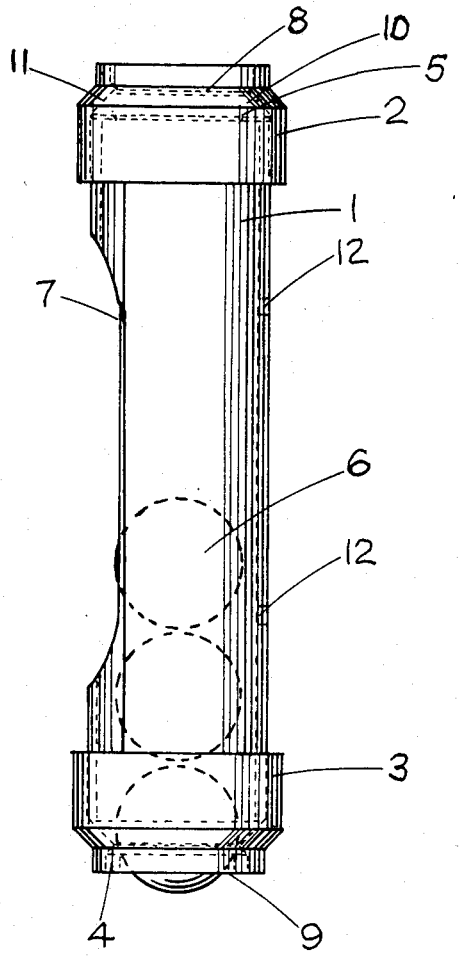
FIG. 2 is a side view of the ball carrier of this disclosure.

FIG. 2 is a side view of the tubular part 1 of the ball carrier of this disclosure which shows the profile of the sight opening 7 with the golf balls 6 visible in the sight opening 7.

Figure 3:
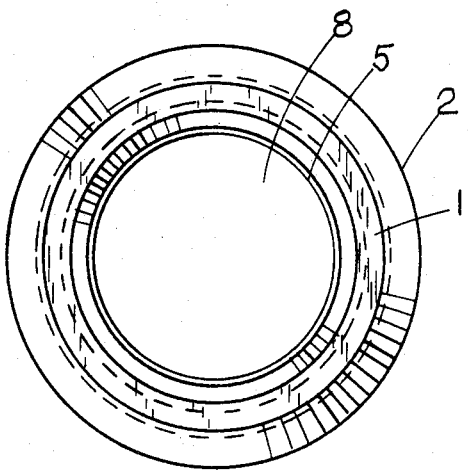
FIG. 3 is a top view down the axis of the tubular ball carrier of this disclosure.

FIG. 3 is a top view down the axis of the tubular carrier and through aperture 8 of the top coupling 2. The edge of the flexible annular ring 5 is visible. Dotted lines show the outside diameter of the flexible annular ring 5 and the upper rim of the tubular plastic part 1. The bottom coupling 3 is not indicated, nor are any balls.

Figure 4:
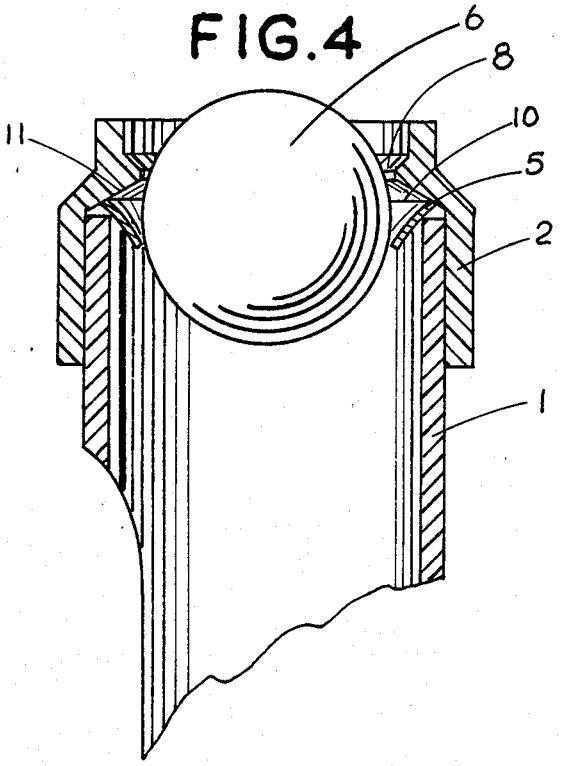
FIG. 4 is a side view in half section of the annular ring and its shape on flexing during ball entry to the carrier.

FIG. 4 is a side view in half section showing a ball 6 after it has passed through the top aperture 8 of top coupling 2 and has caused the flexible annular ring 5 to flex downward during ball entry. The side walls of the rigid plastic tubing 1 are indicated, and the tapered opening 11 for upward flexing of the annular ring 5 is shown. The annular ring 5 flexes away from the top inside wall of the coupling 2 when the ball 6 is being added to the carrier. The spacing for the flexible annular ring is shown as 10.

Figure 5:
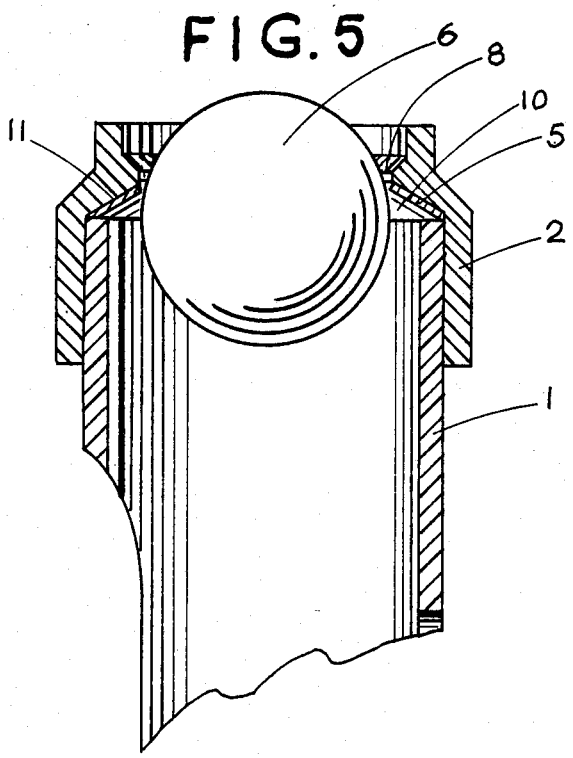
FIG. 5 is a side view in half section of the annular ring and its shape on flexing during ball exit from the carrier.

FIG. 5 is a side view in half section showing a ball 6 after it has been moved up against the flexible annular ring 5 on exit of the ball from the tubular carrier 1. The flexure of the flexible annular ring 5 against the tapered inside top wall of top coupling 2 utilizes the tapered opening 11 and the spacing 10 for the flexible annular ring.

Figure 6:
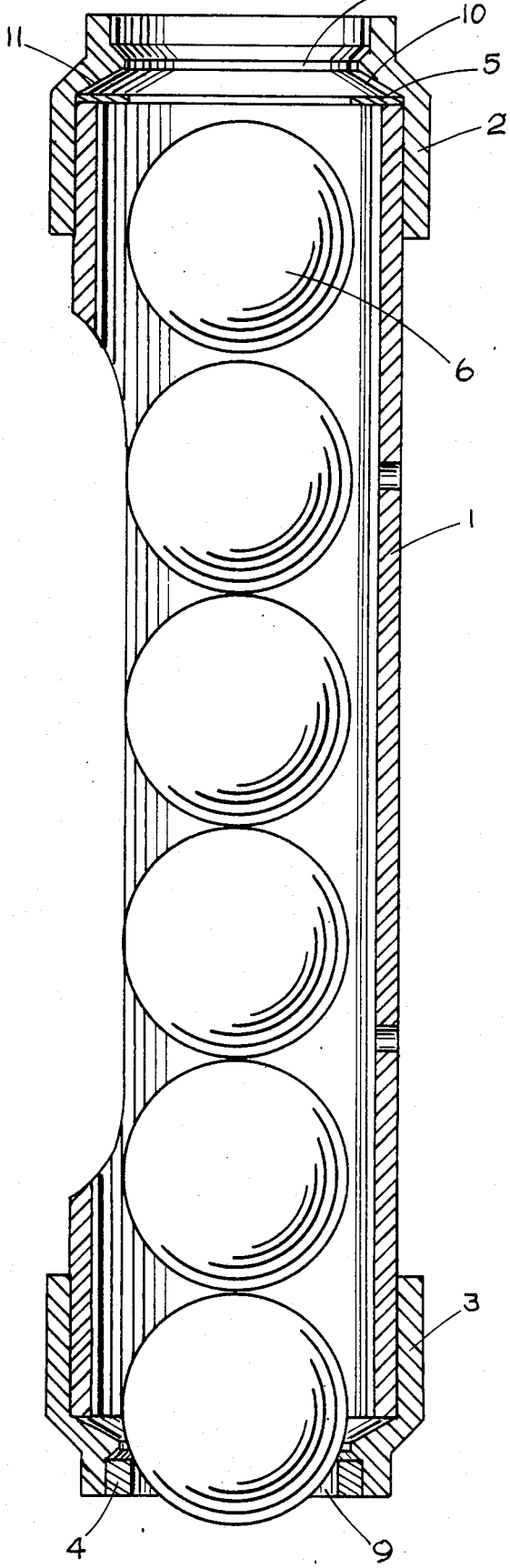
FIG. 6 is a side view in half section of the ball carrier showing the annular ring in its flat, relaxed position.

FIG. 6 is a side view in half section of the tubular plastic part 1 with the top coupling 2 and bottom coupling 3 of the carrier. The flexible annular ring 5 is shown in its relaxed position in its spacing 10 between the top rim of tubular part 1 and the tapered opening 11 at the inside top wall of the top coupling 2. FIG. 6 at the bottom coupling 3 shows the rigid retaining ring 4 sized to prevent the smaller golf ball (British) from passing through bottom aperture 9, but allowing fingers to move the ball upward from the bottom for exit through top aperture 8 of the top coupling 2 after flexure of the flexible annular ring 5 as indicated in FIG. 5.

In all of the above side views in half section contained in FIGS. 4, 5 and 6, the ball 6 is not sectioned.

The design details illustrated in the drawings show a large open sight 7 in FIGS. 1 and 2. This open sight is advantageous since the balls are readily visible and since specific balls are readily located. The bottom aperture 9 of FIG. 1 allows the balls to be pushed upward from the bottom to further facilitate their inspection. Nicked or cut balls can be selected for practice or for playing holes with water obstacles where ball losses are likely. Unmarred balls can be selected for putting. The golf balls slide easily in rigid plastic tubing so that ball manipulation, including addition and withdrawal through the top opening, is readily accomplished. However, whenever a golf ball carrier is laid on the ground in a horizontal position, it is objectionable to have easy rolling balls spill out of the carrier at an inopportune moment. To solve this difficulty, this disclosure employs a thin flexible annular ring to keep the balls from rolling out of a carrier in a horizontal position while permitting easy addition and withdrawal of balls. If only one golf ball size were employed, this annular ring might be fixed in size and permanently mounted. However, for ease of addition and withdrawal, an annular ring which is free to flex is superior to the same ring which is held in a fixed position. In addition, because of the different sizes of golf balls in the United States and Great Britain, it is necessary to have removable and replaceable flexible annular rings to be used with the particular golf balls being carried and being played.

The United States Golf Association specified on Jan. 1, 1932, that a golf ball will have an outside diameter of not less than 1.68 inches, while weighing not more than 1.62 oz. A specified velocity standard was added as well after Jan. 1, 1942.

The Royal and Ancient Golf Club of Great Britain on May 1, 1921, specified balls in championships to be not less than 1.62 inches and not less than 1.62 oz.

The British golf ball has its adherents in the United States where it is used by some golfers in non-tournament play. Because of this use, a separate flexible annular ring suitable for the smaller British ball has been designed for insertion in place of the flexible annular ring designed for the U.S.G.A. ball. In this way the ball carrier can be employed with either type of ball.

The construction of this disclosure allows interchangeable flexible annular rings to be inserted or withdrawn. These rings are fitted in the space between the top rim of the tubular section with the sight opening and the inside top wall of the top coupling which top inside wall tapers from the inside bore at the aperture of the top coupling to the top inside wall of the top reducing coupling. The inside of the top reducing coupling should not be flat against the flexible annular ring but should possess a taper from the ball opening to the inside wall shoulder of the top reducing coupling. This taper is required to permit upward flexing of the flexible annular ring during golf ball removal. This taper advantageously is around 45° as measured from a horizontal line which is perpendicular to the tubular axis so that sufficient upward flexing of the flexible annular ring can occur. The inside diameter of the tubular section with the sight opening should be great enough so that downward flexing of the annular ring is sufficient to readily allow ball entry. No downward taper is required since the flexible annular ring does not press against any restriction except the rim of the tubular section. If the wall of the tubular section is so thick that flexing of the flexible annular ring is prevented by almost total support of the annular ring extending to near the inside diameter of the annular ring, then flexing of the annular ring is restricted, and ball entry is difficult. The flexible annular ring must have space in which to flex for easy ball entry and removal. The flexible annular ring should be supported by enough tubular wall thickness so that the annular ring does not move out of its groove. Wall thickness of the tubular section also must be great enough to prevent flexing of the ball sight opening and loss of balls through such flexing. If desired, the top rim of the tubular section can be tapered from its outside diameter downward to permit greater downward flexing of the flexible annular ring, but, because of the large inside diameter of the tubular section, rim taper is not necessary to sufficient annular ring flexing downward.

The flexible annular rings are made of rubber or a similar elastomeric material. They should be relatively thin so that they can be readily flexed. Their outside diameter is the same diameter as the outside diameter of the tubular plastic section containing the sight opening. These elastomeric annular rings flex between their outside diameter and their inside diameter during entry and exit of the golf balls. The inside diameter is sized for the type of golf balls being played. For U.S.G.A. regulation balls, the inside diameter of a typical flexible annular ring is 1.625 inches (41.275 mm). For British golf balls the inside diameter of a typical flexible annular ring is 1.5625 inches (39.6875 mm). These dimensions are 0.055 inch (1.40 mm) to 0.057 inch (1.46 mm) smaller than the corresponding golf ball. A diameter around 1/16 inch (0.0625 inch) (1.5875 mm) smaller than the golf ball is a suitable generalization.

The flexible annular ring is nominally of 1/16" (0.0625 inch) (1.5875 mm) in thickness. A thin annular ring of about this size leaves room for flexure of the ring against the top reducing coupling, avoids having to leave too much space from the top rim of the tubular section to the inside shoulder of the top reducing coupling, and avoids having to use too much finger pressure force to insert and remove the golf balls. Annular rings of around $\frac{3}{8}$" (0.125 inch) (3.175 mm) and greater require too much force.

A styrene-butadiene-rubber (SBR) having a Shore A hardness of 70 has been found suitable as an annular ring material. This material in a thickness of 0.070 inch (1.778 mm) has been found to be useful. The annular rubber ring may advantageously contain a textile reinforcement as its middle layer. The textile reinforcement serves to maintain dimensional integrity of the annular ring so that the annular ring can be removed and replaced with another size annular ring. The replacement ring will flatten out in its groove with little urging. The fiber reinforcement also tends to make the ring flex as a unit without coming out of its groove.

While an annular ring of SBR rubber with a cloth insert measuring 0.070 inch (1.778 mm) thick with a Shore A durometer of 70 has been found useful, other flexible annular rings may be employed following the general principles described. Changes in annular ring elastomer, thickness, durometer hardness and textile reinforcement (including its absence) are possible within the scope of this invention. Similarly, the diameter of the ball opening in the flexible annular ring can be modified with different elastomers, ring thickness, durometer hardness and textile reinforcement. In a relaxed position, however, the ball opening in the flexible annular ring will be smaller than the outside diameter of the golf ball employed. The flexible annular ring normally contains flat parallel surfaces and may be cut or punched out of rubber sheets. However, flexible annular rings can be molded with greater thickness at their outside diameter than their inside diameter. In such a case, dimension adjustments are required to provide the desired flexing.

The rigid plastic employed in the tubular section with the sight opening should be of sufficient stiffness so that the sight opening resists flexing to enlarge it and thereby risk losing the balls through the enlarged opening. The plastic material employed and the wall thickness of the elongated rigid plastic tubing with sight opening are selected to allow little flexing of the sight opening. The thickness of the wall of the plastic tubing also serves as support for the bottom face of the flexible annular ring. It thus should be of sufficient thickness so that the flexible annular ring is retained in its groove during ball entry and exit. The thickness of the plastic tubing wall, however, should not be so great that downward flexing of the flexible annular ring is hindered. The sight opening should be slightly less than the smallest golf ball diameter in order to readily view the golf balls and in order to move them readily by finger contact with the balls. An example of a suitable sight opening range is from around 1 7/16 (1.44) inches (36.5 mm) to around 1 17/32 (1.53) inches (38.9 mm). If the opening is larger, a British golf ball may slide through the opening with very slight wall flexure.

The inside diameter of the rigid plastic tubing must be greater than that of the U.S.G.A. official ball. To allow ease of movement of the balls with fingers inserted at the sight opening, the inside diameter of the plastic tubing preferably is 2 1/16 (2.06) inches (52.4 mm), while the outside diameter preferably is 2 3/8 (2.38) inches (60.3 mm).

Thus the wall thickness is preferably about 5/32 (0.156) inch (3.97 mm). This wall thickness provides firm retention of the flexible annular ring while permitting downward flexing of the flexible annular ring on ball entry. Depending on flexible annular ring composition, dimensions and construction, other tubing sizes can be employed.

The rigid plastics employed desirably possess impact resistance so that they can withstand handling of the ball carrier. Because of the exposure to sunlight, the plastics used can contain ultra-violet stabilizers to protect them against degradation, or they can be painted or covered with an opaque coating of a light-stable polymer. Since the top and bottom couplings are attached to the tubing with the sight opening, it is preferable that rigid plastics which may be joined by solvent cement are employed. For this reason, the plastic in the tubular section and the couplings desirably are the same resin. Examples of plastics which satisfy these criteria are impact modified rigid polyvinyl chloride and polymers of acrylonitrile-butadiene-styrene (ABS). High density polyethylenes and impact modified polypropylenes also can be employed, but attachment of tubing and couplings of such units is accomplished by means other than solvent cement adhesives. Heat sealed joints or mechanical junctions such as threaded joints or pinned joints can be used with the latter plastics. Such joints can also be employed with PVC or ABS in lieu of adhesive bonding.

The plastics employed desirably possess a flexural modulus measured by ASTM D 790 of at least 75,000 psi at 73° F. and generally above 100,000 psi. A flexural modulus of around 150,000 to 300,000 is preferred, although there is no upper limit provided the plastic employed has good impact strength. The Izod Impact value measured by ASTM D 256 A desirably is above 1.0 ft.-lb./in. of notch measured on a ⅛ inch thick specimen.

In order to exhibit sufficient resistance to flexure and to support the flexible annular ring, the wall thickness of the tubular section with the sight opening generally is 5/32 inch (0.156 inch) (3.97 mm) thick, although wall thickness of 1/16 inch (0.063 inch) (1.59 mm) to ¼ inch (0.250 inch) (6.35 mm) can be employed, depending on the stiffness of the rigid plastic employed, and depending on the composition and construction of the flexible annular ring. A wall thickness of under ¼ inch is desirable to allow for annular ring flexing. If the wall thickness is too small, the flexible annular ring is not supported well enough to prevent its riding out of its positioning groove. For this reason, wall thicknesses below ⅛ inch are seldom employed.

The top coupling has an annular opening of 1 11/16 inch (1.688 inch) (42.86 mm) which is only slightly greater than the diameter of the U.S.G.A. regulation golf ball. This opening serves to guide the golf ball directly over the opening in the flexible annular ring and prevents off-center entry to the flexible annular ring. The inside of the top coupling is tapered from the aperture for golf ball entry to the inside wall of the coupling. This taper allows upward flexing of the flexible annular ring when the golf balls are withdrawn and supports the flexible annular ring. The taper measured from the ball entry aperture to the inside of the coupling wall shoulder is generally at an angle of 30° or greater. An angle of 45° is preferred. Angles above 60° are undesirable since they fail to sufficiently support the flexible annular ring on upward flexing. The taper angle is measured downward from a horizontal line which is perpendicular to the tubing axis.

The bottom coupling has an annular opening whose inside diameter is less than that of the British golf ball. This bottom aperture should be around 1½ inch (1.500 inches) (38.1 mm) to allow finger movement of the bottom golf ball without restricting the fingers. This bottom aperture size may be obtained by cementing or mechanically attaching a retaining ring of 1.500 inch inside diameter, 1⅞ inches (1.875 inch) (47.6 mm) outside diameter, and of around ¼ inch (0.250 inch) (6.35 mm) length to the inside of the bottom coupling. This retaining ring can be employed in lieu of making the bottom coupling from a different molding than the top coupling. However an integral bottom coupling can be employed with the desired dimensions molded into one piece.

Since attachment by solvent cement adhesives is a convenient method of attachment of the coupling parts and the tubular section with sight opening, all of these components are usually made of the same rigid plastic material to insure satisfactory joints using solvent cements.

The elongated tubular ball carrier can be made in various lengths to accommodate different quantities of golf balls. Most frequently it is made to hold six golf balls.

The ball carrier usually is permanently mounted on the side of a golf bag by rivets or other mechanical fasteners inserted through holes in the side of the rigid plastic tubing on the walls opposite the sight opening. A thick plastic tubing wall of around 5/32 inch (0.156 inch) (3.97 mm) is desirable to prevent pullout of mechanical fasteners. The ball carriers, however, can be mounted temporarily on golf bags. For temporary mounting, the ball carrier can be riveted to belts which are buckled on golf bags. Alternately, the ball carrier can be riveted to a flat strap formed into a hook at one end. The hook of the strap with the ball carrier can be set over the lip of a golf bag to temporarily attach the ball carrier to the golf bag.

I claim:

1. A device for carrying golf balls, comprising: a normally vertical rigid plastic elongated tubular section with an elongated sight opening extending for the major part of the length of the said tubular section, with said sight opening width at inside wall of said tubular section being less than 1.62 inches, having affixed top and bottom rigid plastic reducing coupling end pieces, with said bottom reducing coupling having its bottom opening less than 1.62 inches, with said top reducing coupling having its top opening greater than 1.68 inches, with said top reducing coupling positioned on said tubular section to loosely retain a flexible annular ring between upper rim of said tubular section and inside of said top reducing coupling, with inside of said top reducing coupling contoured to allow upward flexing of said flexible annular ring, with said tubular section having a wall thickness to retain and yet to allow downward flexing of said flexible annular ring, with said flexible annular ring sized to allow entry and exit of said golf balls from said carrier device using finger pressure to cause flexing of the said annular ring by the said golf ball, with said flexible annular ring in relaxed condition preventing exit of said golf balls, with said flexible annular ring being removable and replaceable, thereby allowing use of said carrier device for storage of said golf balls of U.S.G.A diameter dimension or for storage of said golf balls of British diameter dimension by insertion of said flexible annular ring in said carrier device with said flexible annular ring having an inside diameter slightly smaller than the outside diameter of said golf balls being stored in said carrier device, and with said carrier device having holes and/or other attaching means for mounting said carrier device on a support.

2. The golf ball carrier of claim 1 wherein the rigid plastic elongated tubular section with an elongated sight opening and its top and bottom rigid plastic reducing coupling end pieces are made from an impact resistant rigid polyvinyl chloride resin.

3. The golf ball carrier of claim 1 wherein the rigid plastic elongated tubular section with an elongated sight opening and its top and bottom rigid plastic reducing coupling end pieces are made from an acrylonitrile-butadiene-styrene resin.

4. The golf ball carrier of claim 1 wherein the rigid plastic elongated tubular section with an elongated sight opening and its top and bottom rigid plastic reducing coupling end pieces are made from a high density polyethylene.

5. The golf ball carrier of claim 1 wherein the rigid plastic elongated tubular section with an elongated sight opening and its top and bottom rigid plastic reducing coupling end pieces are made from an impact resistant isotactic polypropylene.

6. The golf ball carrier of claim 1 wherein the flexible annular ring is a rubber with a Shore A Durometer between 50 and 90.

7. The golf ball carrier of claim 1 wherein the flexible annular ring is an elastomer with a textile fiber reinforcement.

8. The golf ball carrier of claim 1 wherein the flexible annular ring is a rubber with a Shore A Durometer between 60 and 80 containing a textile fiber reinforcement.

9. The golf ball carrier of claim 1 wherein the flexible annular ring is a rubber with a Shore A Durometer of 70 containing a textile fiber cloth insert reinforcement.

10. The golf ball carrier of claim 1 wherein the support for said carrier is a golf club carrier.

* * * * *